US010460687B2

(12) United States Patent
Du

(10) Patent No.: US 10,460,687 B2
(45) Date of Patent: Oct. 29, 2019

(54) DISPLAY PANEL AND GATE DRIVING CIRCUIT THEREOF

(71) Applicant: Shenzhen China Star Optoelectronics Technology Co. Ltd., Shenzhen, Guangdong (CN)

(72) Inventor: Peng Du, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 635 days.

(21) Appl. No.: 15/118,882

(22) PCT Filed: Jul. 11, 2016

(86) PCT No.: PCT/CN2016/089600
§ 371 (c)(1),
(2) Date: Aug. 13, 2016

(87) PCT Pub. No.: WO2017/206268
PCT Pub. Date: Dec. 7, 2017

(65) Prior Publication Data

US 2019/0156774 A1 May 23, 2019

(30) Foreign Application Priority Data

Jun. 1, 2016 (CN) ..... 2016 1 0384103

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 2300/0408* (2013.01);
(Continued)

(58) Field of Classification Search
CPC ..... G09G 3/3677; G09G 3/3266; G09G 2300/0408; G09G 2310/0267;
(Continued)

(56) References Cited

U.S. PATENT DOCUMENTS

2010/0260312 A1* 10/2010 Tsai ..... G09G 3/3677 377/79
2012/0320021 A1* 12/2012 Chang ..... G09G 3/3655 345/211

(Continued)

*Primary Examiner* — Tom V Sheng
(74) *Attorney, Agent, or Firm* — Andrew C. Cheng

(57) ABSTRACT

The invention provides a display panel and a gate driving circuit thereof including multiple stages of gate driving units. Each gate driving unit includes: a first pulling control circuit for outputting a first pulling control signal at a first node; a first pulling circuit for generating a gate driving signal according to the first pulling control signal and a first clock signal; a second pulling control circuit for outputting a second pulling control signal; and a second pulling circuit for pulling levels at the first node and an output terminal of the gate driving signal according to the second pulling control signal. A frequency of the second pulling control signal is lower than a frequency of the first clock signal but higher than a refresh rate of the display panel. The invention can prevent thin film transistor characteristic drift and thereby improve reliability of the gate driving unit.

17 Claims, 5 Drawing Sheets

(52) U.S. Cl.
CPC . *G09G 2310/0286* (2013.01); *G09G 2310/08* (2013.01); *G09G 2330/021* (2013.01)

(58) Field of Classification Search
CPC ..... G09G 2310/0286; G09G 2310/08; G09G 2330/021
See application file for complete search history.

(56) References Cited

U.S. PATENT DOCUMENTS

2015/0288364 A1* 10/2015 Lin ..... H03K 19/00384 377/75
2015/0294636 A1* 10/2015 Yu ..... G09G 3/3655 345/204
2016/0125824 A1* 5/2016 Dai ..... G09G 3/3648 345/213
2016/0140922 A1* 5/2016 Dai ..... G11C 19/287
2016/0253938 A1* 9/2016 Yu ..... G09G 3/3674 345/214
2016/0275886 A1* 9/2016 Dai ..... G11C 19/28
2016/0284294 A1* 9/2016 Dai ..... G09G 3/3648
2016/0284295 A1* 9/2016 Dai ..... G09G 3/3648
2016/0284296 A1* 9/2016 Dai ..... G09G 3/36
2016/0343331 A1* 11/2016 Dai ..... G09G 3/3677
2017/0236480 A1* 8/2017 Dai ..... G09G 3/3677 345/213

* cited by examiner

DISPLAY PANEL AND GATE DRIVING CIRCUIT THEREOF

TECHNICAL FIELD

The invention relates to the field of liquid crystal display, and particularly to a display panel and a gate driving circuit thereof.

DESCRIPTION OF RELATED ART

A GOA (also referred to as Gate Driver On Array or Gate On Array) circuit is a technology of using a conventional TFT-LCD array process to manufacture a gate line scanning drive signal circuit on an array substrate so as to achieve a progressive scanning driving mode for gate lines. Compared with traditional COF and COG techniques, it not only can save the manufacturing cost, but also can eliminate the gate driving chip bonding process, and therefore is extremely beneficial to improve productivity and increase the integration of display device.

In actual applications, each stage of GOA circuit is designed with a corresponding auxiliary pull-down circuit(s), and usually is designed with two auxiliary pull-down circuits. The two auxiliary pull-down circuits alternately work in different time periods in order to perform pull-down operations onto a node Q and a gate driving signal in the GOA circuit. Currently, the auxiliary pull-down circuits include two switching frequencies, one switching frequency is same as a frequency of a clock signal, and the other one switching frequency is that switching is performed once every several frames. If the switching frequency is same as the frequency of the clock signal, thin film transistors of the GOA circuit would suffer from a pressure of high frequency; while if the switching frequency is that switching is performed once every several frames, the thin film transistors of the GOA circuit would suffer from a pressure of low frequency, resulting in abnormal working of the GOA circuit.

SUMMARY

Accordingly, a technical problem primarily to be solved by the invention is to provide a display panel and a gate driving circuit thereof, so as to solve the above issues.

Specifically, the invention provides a gate driving circuit including multiple stages of gate driving units. Each stage of gate driving unit includes: a first pulling control circuit, configured for outputting a first pulling control signal at a first node; a first pulling circuit, coupled to the first node and configured for receiving a first clock signal and generating a gate driving signal according to the first pulling control signal and the first clock signal, and having a gate driving signal output terminal for outputting the gate driving signal; a second pulling control circuit, configured for receiving a first signal, a second signal, a third signal and a fourth signal, and outputting a second pulling control signal according to the first signal, the second signal, the third signal and the fourth signal; a second pulling circuit, coupled to the first node and the gate driving signal output terminal and configured for receiving the second pulling control signal and pulling a level at the first node and a level at the gate driving signal output terminal according to the second pulling control signal. A frequency of the second pulling control signal is lower than a frequency of the first clock signal but higher than a refresh rate of a display panel to which the gate driving circuit is applied, the second pulling control signal is a square wave pulse control signal. The first signal is a second clock signal, and a ratio of a frequency of the second clock signal to the frequency of the first clock signal is in a range from 2 to 50.

In an embodiment, the frequency of the second clock signal is 4 times of the frequency of the first clock signal, the third signal is the second signal of second preceding stage of gate driving unit, and the fourth signal is the second signal of second succeeding stage of gate driving unit.

The invention further provides a gate driving circuit including multiple stages of gate driving units. Each stage of gate driving unit includes: a first pulling control circuit, configured for outputting a first pulling control signal at a first node; a first pulling circuit, coupled to the first node and configured for receiving a first clock signal and generating a gate driving signal according to the first pulling control signal and the first clock signal, and having a gate driving signal output terminal for outputting the gate driving signal; a second pulling control circuit, configured for receiving a first signal, a second signal, a third signal and a fourth signal and outputting a second pulling control signal according to the first signal, the second signal, the third signal and the fourth signal; a second pulling circuit, coupled to the first node and the gate driving signal output terminal and configured for receiving the second pulling control signal and pulling a level at the first node and a level at the gate driving signal output terminal according to the second pulling control signal. A frequency of the second pulling control signal is lower than a frequency of the first clock signal but higher than a refresh rate of a display panel to which the gate driving circuit is applied.

In an embodiment, the second pulling control signal is a square wave pulse control signal.

In an embodiment, the first signal is a second clock signal, and a ratio of a frequency of the second clock signal to the frequency of the first clock signal is in a range from 2 to 50.

In an embodiment, the frequency of the second clock signal is 4 times of the frequency of the first clock signal, the third signal is the second signal of second preceding stage of gate driving unit, and the fourth signal is the second signal of second succeeding stage of gate driving unit.

In an embodiment, the frequency of the second clock signal is 2 times of the frequency of the first clock signal, the third signal is the second signal of fourth preceding stage of gate driving unit, and the fourth signal is the second signal of fourth succeeding stage of gate driving unit.

In an embodiment, the first pulling control circuit includes a first thin film transistor, a first terminal of the first thin film transistor is configured for receiving a first reference voltage, a second terminal of the first thin film transistor is configured for receiving the gate driving signal of second preceding stage of gate driving unit, and a third terminal of the first thin film transistor is connected to the first node.

In an embodiment, the first pulling circuit includes a second thin film transistor and a capacitor, a first terminal of the second thin film transistor is configured for receiving the first clock signal, a second terminal of the second thin film transistor is connected to the first node, a third terminal of the second thin film transistor acts as the gate driving signal output terminal, a terminal of the capacitor is connected to the first node and another terminal of the capacitor is connected to the third terminal of the second thin film transistor.

In an embodiment, the second pulling control circuit includes a third thin film transistor, a fourth thin film transistor, a fifth thin film transistor, a sixth thin film transistor, a seventh thin film transistor, an eighth thin film transistor, a ninth thin film transistor, a tenth thin film transistor, an eleventh thin film transistor, a twelfth thin film transistor and a thirteenth thin film transistor; a first terminal of the third thin film transistor and a first terminal of the fourth thin film transistor are configured for receiving the first reference voltage, a second terminal of the third thin film transistor is configured for receiving the third signal, a second terminal of the fourth thin film transistor is configured for receiving the second signal of current stage of gate driving unit, a third terminal of the third thin film transistor and a third terminal of the fourth thin film transistor are connected to a first terminal of the fifth thin film transistor, a second terminal of the seventh thin film transistor and a second terminal of the eighth thin film transistor, a second terminal of the fifth thin film transistor and a second terminal of the twelfth thin film transistor are configured for receiving the fourth signal, a second terminal of the thirteenth thin film transistor is connected to the gate driving signal output terminal; a third terminal of the fifth thin film transistor, a third terminal of the seventh thin film transistor, a third terminal of the ninth thin film transistor, a third terminal of the twelfth thin film transistor and a third terminal of the thirteenth thin film transistor are configured for receiving a second reference voltage, a first terminal and a second terminal of the sixth thin film transistor are configured for receiving the first reference voltage, a third terminal of the sixth thin film transistor is connected to a first terminal of the seventh thin film transistor and a second terminal of the ninth thin film transistor, a first terminal of the eighth thin film transistor is configured for receiving the first reference voltage, a third terminal of the eighth thin film transistor is connected to a first terminal of the ninth thin film transistor, a second terminal of the tenth thin film transistor and a second terminal of the eleventh thin film transistor; a first terminal of the tenth thin film transistor is configured for receiving the first signal, a third terminal of the tenth thin film transistor is configured for outputting the second signal, a first terminal of the eleventh thin film transistor is configured for receiving the first signal, a third terminal of the eleventh thin film transistor is connected to a first terminal of the twelfth thin film transistor and a first terminal of the thirteenth thin film transistor, a third terminal of the eleventh thin film transistor is configured for outputting the second pulling control signal.

In an embodiment, the second pulling circuit includes a fourteenth thin film transistor, a fifteenth thin film transistor, a sixteenth thin film transistor and a seventeenth thin film transistor; a first terminal of the fourteenth thin film transistor is connected to the first node, a second terminal of the fourteenth thin film transistor and a second terminal of the fifteenth thin film transistor are connected to the third terminal of the eleventh thin film transistor; a third terminal of the fourteenth thin film transistor, a third terminal of the fifteenth thin film transistor, a third terminal of the sixteenth thin film transistor and a third terminal of the seventeenth thin film transistor are configured for receiving the second reference voltage, a first terminal of the fifteenth thin film transistor is connected to the gate driving signal output terminal, a first terminal of the sixteenth thin film transistor is connected to the first node, a second terminal of the sixteenth thin film transistor and a second terminal of the seventeenth are configured for receiving the gate driving signal of second succeeding stage of gate driving unit, a first terminal of the seventeenth thin film transistor is connected to the gate driving signal output terminal.

The invention still further provides a display panel including a gate driving circuit. The gate driving circuit includes multiple stages of gate driving units, and each stage of gate driving unit includes: a first pulling control circuit, configured for outputting a first pulling control signal at a first node; a first pulling circuit, coupled to the first node and configured for receiving a first clock signal and generating a gate driving signal according to the first pulling control signal and the first clock signal, and having a gate driving signal output terminal for outputting the gate driving signal; a second pulling control circuit, configured for receiving a first signal, a second signal, a third signal and a fourth signal and outputting a second pulling control signal according to the first signal, the second signal, the third signal and the fourth signal; a second pulling circuit, coupled to the first node and the gate driving signal output terminal and configured for receiving the second pulling control signal and pulling a level at the first node and a level at the gate driving signal output terminal according to the second pulling control signal. A frequency of the second pulling control signal is lower than a frequency of the first clock signal but higher than a refresh rate of the display panel.

In an embodiment, the second pulling control signal is a square wave pulse control signal.

In an embodiment, the first signal is a second clock signal, and a ratio of a frequency of the second clock signal to the frequency of the first clock signal is in a range from 2 to 50.

In an embodiment, the frequency of the second clock signal is 4 times of the frequency of the first clock signal, the third signal is the second signal of second preceding stage of gate driving unit, and the fourth signal is the second signal of second succeeding stage of gate driving unit.

In an embodiment, the frequency of the second clock signal is 2 times of the frequency of the first clock signal, the third signal is the second signal of fourth preceding stage of gate driving unit, and fourth signal is the second signal of fourth succeeding stage of gate driving unit.

In an embodiment, the first pulling control circuit includes a first thin film transistor, a first terminal of the first thin film transistor is configured for receiving a first reference voltage, a second terminal of the first thin film transistor is configured for receiving the gate driving signal of second preceding stage of gate driving unit, and a third terminal of the first thin film transistor is connected to the first node.

In an embodiment, the first pulling circuit includes a second thin film transistor and a capacitor, a first terminal of the second thin film transistor is configured for receiving the first clock signal, a second terminal of the second thin film transistor is connected to the first node, a third terminal of the second thin film transistor acts as the gate driving signal output terminal, a terminal of the capacitor is connected to the first node and another terminal of the capacitor is connected to the third terminal of the second thin film transistor.

In an embodiment, the second pulling control circuit includes a third thin film transistor, a fourth thin film transistor, a fifth thin film transistor, a sixth thin film transistor, a seventh thin film transistor, an eighth thin film transistor, a ninth thin film transistor, a tenth thin film transistor, an eleventh thin film transistor, a twelfth thin film transistor and a thirteenth thin film transistor; a first terminal of the third thin film transistor and a first terminal of the fourth thin film transistor are configured for receiving the first reference voltage, a second terminal of the third thin film transistor is configured for receiving the third signal, a second terminal of the fourth thin film transistor is configured for receiving the second signal of current stage of gate driving unit, a third terminal of the third thin film transistor and a third terminal of the fourth thin film transistor are connected to a first terminal of the fifth thin film transistor, a second terminal of the seventh thin film transistor and a second terminal of the eighth thin film transistor, a second terminal of the fifth thin film transistor and a second terminal of the twelfth thin film transistor are configured for receiving the fourth signal, a second terminal of the thirteenth thin film transistor is connected to the gate driving signal output terminal; a third terminal of the fifth thin film transistor, a third terminal of the seventh thin film transistor, a third terminal of the ninth thin film transistor, a third terminal of the twelfth thin film transistor and a third terminal of the thirteenth thin film transistor are configured for receiving a second reference voltage, a first terminal and a second terminal of the sixth thin film transistor are configured for receiving the first reference voltage, a third terminal of the sixth thin film transistor is connected to a first terminal of the seventh thin film transistor and a second terminal of the ninth thin film transistor, a first terminal of the eighth thin film transistor is configured for receiving the first reference voltage, a third terminal of the eighth thin film transistor is connected to a first terminal of the ninth thin film transistor, a second terminal of the tenth thin film transistor and a second terminal of the eleventh thin film transistor; a first terminal of the tenth thin film transistor is configured for receiving the first signal, a third terminal of the tenth thin film transistor is configured for outputting the second signal, a first terminal of the eleventh thin film transistor is configured for receiving the first signal, a third terminal of the eleventh thin film transistor is connected to a first terminal of the twelfth thin film transistor and a first terminal of the thirteenth thin film transistor, a third terminal of the eleventh thin film transistor is configured for outputting the second pulling control signal.

In an embodiment, the second pulling circuit includes a fourteenth thin film transistor, a fifteenth thin film transistor, a sixteenth thin film transistor and a seventeenth thin film transistor; a first terminal of the fourteenth thin film transistor is connected to the first node, a second terminal of the fourteenth thin film transistor and a second terminal of the fifteenth thin film transistor are connected to the third terminal of the eleventh thin film transistor; a third terminal of the fourteenth thin film transistor, a third terminal of the fifteenth thin film transistor, a third terminal of the sixteenth thin film transistor and a third terminal of the seventeenth thin film transistor are configured for receiving the second reference voltage, a first terminal of the fifteenth thin film transistor is connected to the gate driving signal output terminal, a first terminal of the sixteenth thin film transistor is connected to the first node, a second terminal of the sixteenth thin film transistor and a second terminal of the seventeenth are configured for receiving the gate driving signal of second succeeding stage of gate driving unit, a first terminal of the seventeenth thin film transistor is connected to the gate driving signal output terminal.

By the above technical solutions, efficacy can be achieved by the invention is that each stage of gate driving unit of the invention includes: a first pulling control circuit for outputting a first pulling control signal at a first node; a first pulling circuit coupled to the first node, for receiving a first clock signal and generating a gate driving signal according to the first pulling control signal and the first clock signal, and having a gate driving signal output terminal for outputting the gate driving signal; a second pulling control circuit for receiving a first signal, a second signal, a third signal and a fourth signal and outputting a second pulling control signal according to the first signal, the second signal, the third signal and the fourth signal; and a second pulling circuit coupled to the first node and the gate driving signal output terminal, for receiving the second pulling control signal and pulling a level at the first node and a level at the gate driving signal output terminal according to the second pulling control signal; a frequency of the second pulling control signal is lower than a frequency of the first clock signal but higher than a refresh rate of a display panel to which the gate driving circuit is applied; accordingly, the drift of thin film transistor characteristic of the gate driving unit can be prevented and the reliability of the gate driving unit can be improved.

BRIEF DESCRIPTION OF THE DRAWINGS

In order to more clearly illustrate technical solutions of embodiments of the invention, drawings will be used in the description of the embodiments of the invention will be given a brief description below. Apparently, the drawings in the following description only are some of embodiments of the invention, the ordinary skill in the art can obtain other drawings according to these illustrated drawings without creative effort.

DETAILED DESCRIPTION OF EMBODIMENTS

In the following, with reference to accompanying drawings of embodiments of the invention, technical solutions in the embodiments of the invention will be clearly and completely described. Apparently, the embodiments of the invention described below only are a part of embodiments of the invention, but not all embodiments. Based on the described embodiments of the invention, all other embodiments obtained by ordinary skill in the art without creative effort belong to the scope of protection of the invention.

Figure 1:
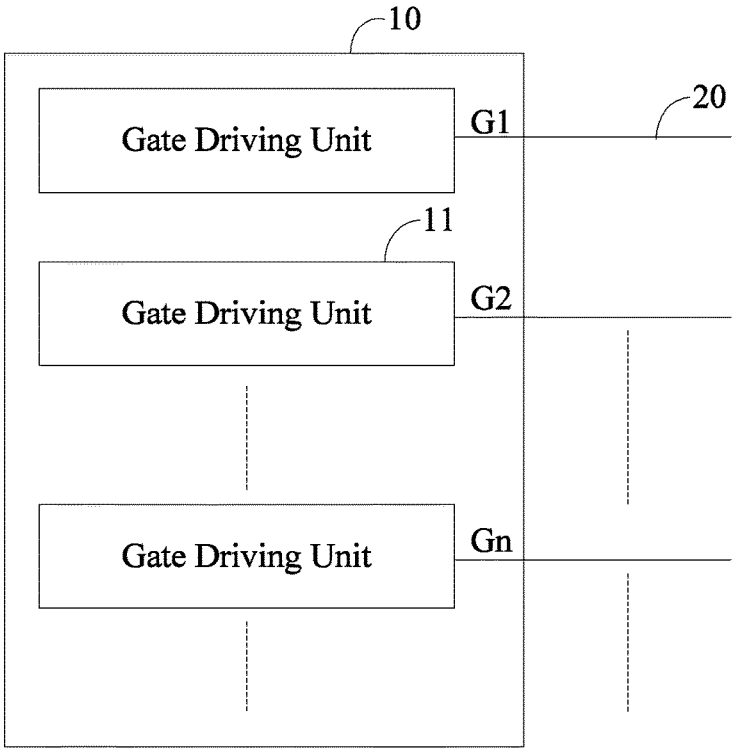
FIG. 1 is a schematic structural view of a gate driving circuit of a first embodiment of the invention.

Referring to FIG. 1, FIG. 1 is a schematic structural view of a gate driving circuit of a first embodiment of the invention. The gate driving circuit as illustrated in this embodiment is applied to a display panel and configured (i.e., structured and arranged) for driving multiple (i.e., more than one) scan lines of the display panel to make the scan lines be turned on.

As illustrated in FIG. 1, the gate driving circuit 10 is connected with multiple scan lines 20. The gate driving circuit 10 is configured for generating gate driving signals to drive the multiple scan lines 20. The gate driving circuit 10 includes multiple stages of gate driving units 11 (connected in cascade), each stage of gate driving unit 10 is corresponding to one scan line 20, and an output terminal of each stage of gate driving unit 11 is connected with one scan line 20.

In the following, the nth stage of gate driving unit 11 is taken as an example for detail description, where n is an integer greater than or equal to 1.

Figure 2:
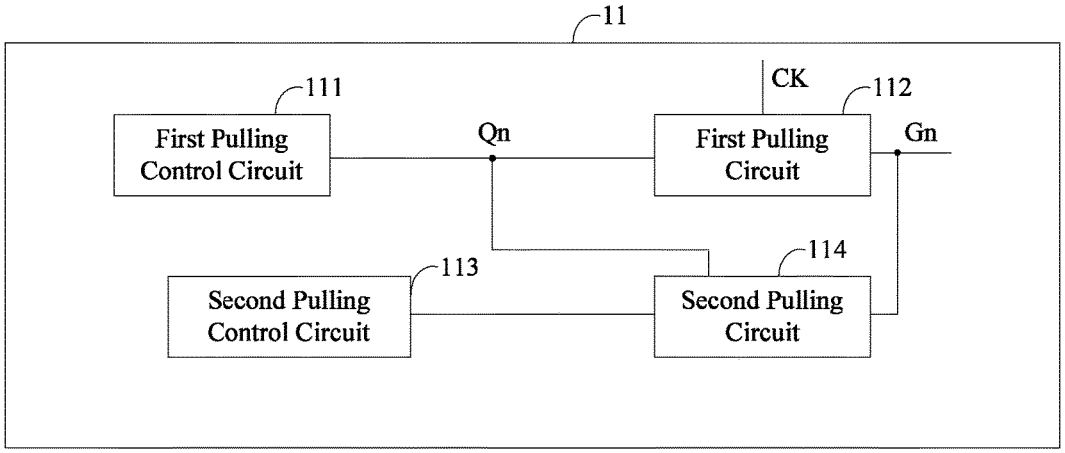
FIG. 2 is a schematic structural view of a gate driving unit in FIG. 1.

As illustrated in FIG. 2, the nth stage of gate driving unit 11 includes a first pulling control circuit 111, a first pulling circuit 112, a second pulling control circuit 113 and a second pulling circuit 114. The first pulling control circuit 111 is configured for outputting a first pulling control signal at a first node $Q_n$. The first pulling circuit 112 is coupled to the first node $Q_n$. The first pulling circuit 112 receives a first clock signal CK and generates a gate driving signal $G_n$ according to the first pulling control signal and the first clock signal CK. A gate driving signal output terminal outputs the gate driving signal $G_n$, i.e., the gate driving signal output terminal of the first pulling circuit 112 outputs the gate driving signal $G_n$. The gate driving signal $G_n$ is used for driving the scan line 20.

When the first pulling control signal and the first clock signal CK both are at logic high levels, the gate driving signal $G_n$ generated by the first pulling circuit 112 according to the first pulling control signal and the first clock signal CK is at a logic high level, and at this time the scan line 20 corresponding to the nth stage of gate driving unit 11 is turned on.

The second pulling control circuit 113 is configured for receiving a first signal, a second signal, a third signal and a fourth signal and outputting a second pulling control signal according to the first signal, the second signal, the third signal and the fourth signal. The second pulling circuit 114 is coupled to the first node $Q_n$ and the gate driving signal output terminal, receives the second pulling control signal, and pulls a level at the first node $Q_n$ as well as a level at the gate driving signal output terminal according to the second pulling control signal.

When the second pulling control signal is at a logic high level, the second pulling circuit 114 pulls the level at the first node $Q_n$ and the level at the gate driving signal output terminal down to a logic low level according to the second pulling control signal, and at this time the scan line 20 corresponding to the nth stage of gate driving unit 11 is turned off.

In the illustrated embodiment, a frequency of the second pulling control signal is lower than a frequency of the first clock signal CK but higher than a refresh rate of the display panel. The refresh rate of the display panel is a(n) number/amount of images displayed by the display panel per second.

The second pulling control circuit 113 controls the frequency of the second pulling control signal according to the first signal, the second signal and the third signal, to make the frequency of the second pulling control signal be lower than the frequency of the first clock signal CK and higher than the refresh rate of the display panel.

The illustrated embodiment can effectively prevent drift of thin film transistor characteristic of the gate driving unit 11 and thereby improve reliability of the gate driving unit 11.

Figure 3:
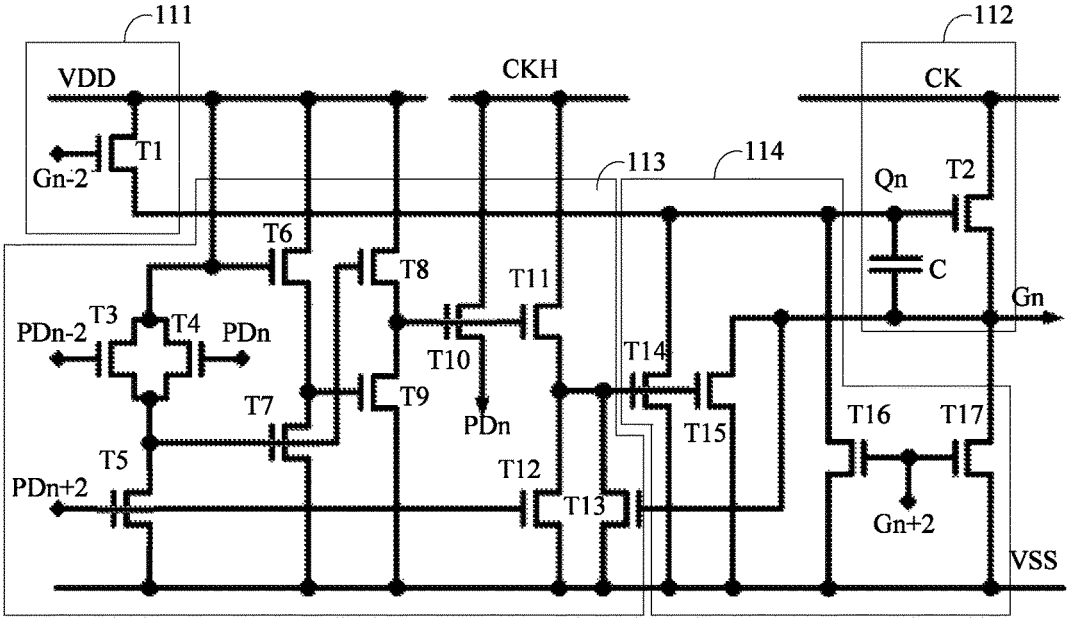
FIG. 3 is a circuit diagram of a gate driving unit of a second embodiment of the invention.

The invention further provides a gate driving unit of a second embodiment, and it will be described on the basis of the gate driving unit of the first embodiment. As illustrated in FIG. 3, the first pulling control circuit 111 includes a first thin film transistor T1, a first terminal of the first thin film transistor T1 is configured for receiving a first reference voltage VDD, a second terminal of the first thin film transistor T1 is configured for receiving a gate driving signal $G_{n-2}$ of second preceding stage of gate driving unit 11, and a third terminal of the first thin film transistor T1 is connected to the first node $Q_n$.

The first pulling circuit 112 includes a second thin film transistor T2 and a capacitor C. A first terminal of the second thin film transistor T2 is configured for receiving the first clock signal CK, a second terminal of the second thin film transistor T2 is connected to the first node $Q_n$, a third terminal of the second thin film transistor T2 is the gate driving signal output terminal and configured for outputting the gate driving signal $G_n$. A terminal of the capacitor C is connected to the first node $Q_n$, and the other terminal of the capacitor C is connected to the third terminal of the second thin film transistor T2.

The second pulling control circuit 113 includes a third thin film transistor T3, a fourth thin film transistor T4, a fifth thin film transistor T5, a sixth thin film transistor T6, a seventh thin film transistor T7, an eighth thin film transistor T8, a ninth thin film transistor T9, a tenth thin film transistor T10, an eleventh thin film transistor T11, a twelfth thin film transistor T12 and a thirteenth thin film transistor T13. A first terminal of the third thin film transistor T3 and a first terminal of the fourth thin film transistor T4 are configured for receiving the first reference voltage VDD, a second terminal of the third thin film transistor T3 is configured for receiving the third signal, a second terminal of the fourth thin film transistor T4 is configured for receiving the second signal of current stage of gate driving unit, a third terminal of the third thin film transistor T3 and a third terminal of the fourth thin film transistor T4 are connected to a first terminal of the fifth thin film transistor T5, a second terminal of the seventh thin film transistor T7 and a second terminal of the eighth thin film transistor T8. A second terminal of the fifth thin film transistor T5 and a second terminal of the twelfth thin film transistor T12 are configured for receiving the fourth signal, a second terminal of the thirteenth thin film transistor T13 is connected to the output terminal of gate driving signal $G_n$. A third terminal of the fifth thin film transistor T5, a third terminal of the seventh thin film transistor T7, a third terminal of the ninth thin film transistor T9, a third terminal of the twelfth thin film transistor T12 and a third terminal of the thirteenth thin film transistor T13 are configured for receiving a second reference voltage VSS. A first terminal and a second terminal of the sixth thin film transistor T6 is configured for receiving the first reference voltage VDD, a third terminal of the sixth thin film transistor T6 is connected to a first terminal of the seventh thin film transistor T7 and a second terminal of the ninth thin film transistor T9. A first terminal of the eighth thin film transistor T8 is configured for receiving the first reference voltage VDD. A third terminal of the eighth thin film transistor T8, a first terminal of the ninth thin film transistor T9 and a second terminal of the tenth thin film transistor T10 are connected to a second terminal of the eleventh thin film transistor T11, a first terminal of the tenth thin film transistor T10 is configured for receiving the first signal, a third terminal of the tenth thin film transistor T10 is for outputting the second signal of current stage of gate driving unit, a first terminal of the eleventh thin film transistor T11 is configured for receiving the first signal, a third terminal of the eleventh thin film transistor T11 is connected to a first terminal of the twelfth thin film transistor T12 as well as a first terminal of the thirteenth thin film transistor T13, and a third terminal of the eleventh thin film transistor T11 is for outputting the second pulling control signal.

The second pulling circuit 114 includes a fourteenth thin film transistor T14, a fifteenth thin film transistor T15, a sixteenth thin film transistor T16 and a seventeenth thin film transistor T17. A first terminal of the fourteenth thin film transistor T14 is connected to the first node, a second terminal of the fourteenth thin film transistor and a second terminal of the fifteenth thin film transistor T15 are connected to the third terminal of the eleventh thin film transistor T11. A third terminal of the fourteenth thin film transistor T14, a third terminal of the fifteenth thin film transistor T15, a third terminal of the sixteenth thin film transistor T16 and a third terminal of the seventeenth thin film transistor T17 are configured for receiving the second reference voltage VSS. A first terminal of the fifteenth thin film transistor T15 is connected to the output terminal of gate driving signal $G_n$, a first terminal of the sixteenth thin film transistor T16 is connected to the first node. A second terminal of the sixteenth thin film transistor T16 and a second terminal of the seventeenth thin film transistor T17 are configured for receiving a gate driving signal $G_{n+2}$ of second succeeding stage of gate driving unit. A first terminal of the eighteenth thin film transistor T17 is connected to the output terminal of gate driving signal $G_n$. The second reference voltage VSS is a logic low level.

Preferably, the second pulling control signal is a square wave pulse control signal. The first signal preferably is a second clock signal CKH, and a ratio of a frequency of the second clock signal CKH to the frequency of the first clock signal CK is in a range of 2-50.

Preferably, the frequency of the second clock signal CKH is 4 times of the frequency of the first clock signal CK. At this situation, the second signal is $PD_n$, the third signal $PD_{n-2}$ is the second signal of second preceding stage of gate driving unit, and the fourth signal $PD_{n+2}$ is the second signal of second succeeding stage of gate driving unit. That is, the second pulling control circuit 113 outputs the second pulling control signal according to the second clock signal CKH, the second signal $PD_n$, the third signal $PD_{n-2}$ and the fourth signal $PD_{n+2}$. A working principle of the gate driving unit will be described in detail with reference to timing diagrams illustrated in FIGS. 4 and 5.

Figure 4:
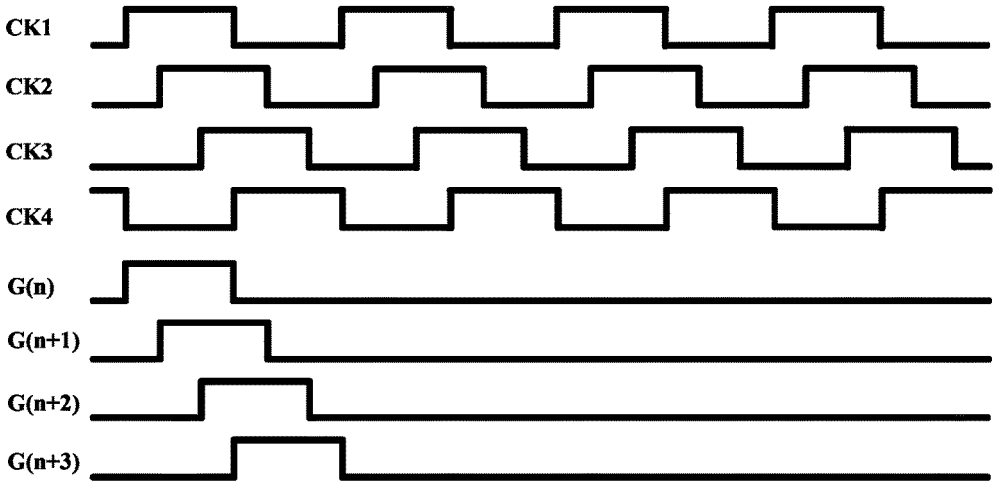
FIG. 4 is a timing diagram of first clock signals and gate driving signals in FIG. 3.

As illustrated in FIG. 4, when the gate driving signal $G_{n-2}$ of second preceding stage of gate driving unit is at a logic high level, the first thin film transistor T1 is turned on, the first pulling control signal outputted by the third terminal of the first thin film transistor T1 at the first node $Q_n$ is at a logic high level, the second thin film transistor T2 is turned on, the gate driving signal Gn is same as the first clock signal CK.

When the gate driving signal $G_{n-2}$ of second preceding stage of gate driving unit is at a logic low level, the first thin film transistor T1 is turned off, the third terminal of the first thin film transistor T1 does not output the first pulling control signal, owing to charging and discharging effects of the capacitor C, the first node Qn is at a logic high level, the second thin film transistor T2 is turned on, and the gate driving signal $G_n$ is same as the first clock signal CK.

When the gate driving signal $G_{n+2}$ of second succeeding stage of gate driving unit is at a logic high level, the sixteenth thin film transistor T16 and the seventeenth thin film transistor T17 are turned on, the sixteenth thin film transistor T16 pulls the level of the first node $Q_n$ from a logic high level to a logic low level, the second thin film transistor T2 is turned off, the seventeenth thin film transistor T17 pulls the level of the gate driving signal $G_n$ from a logic high level to a logic low level.

Figure 5:
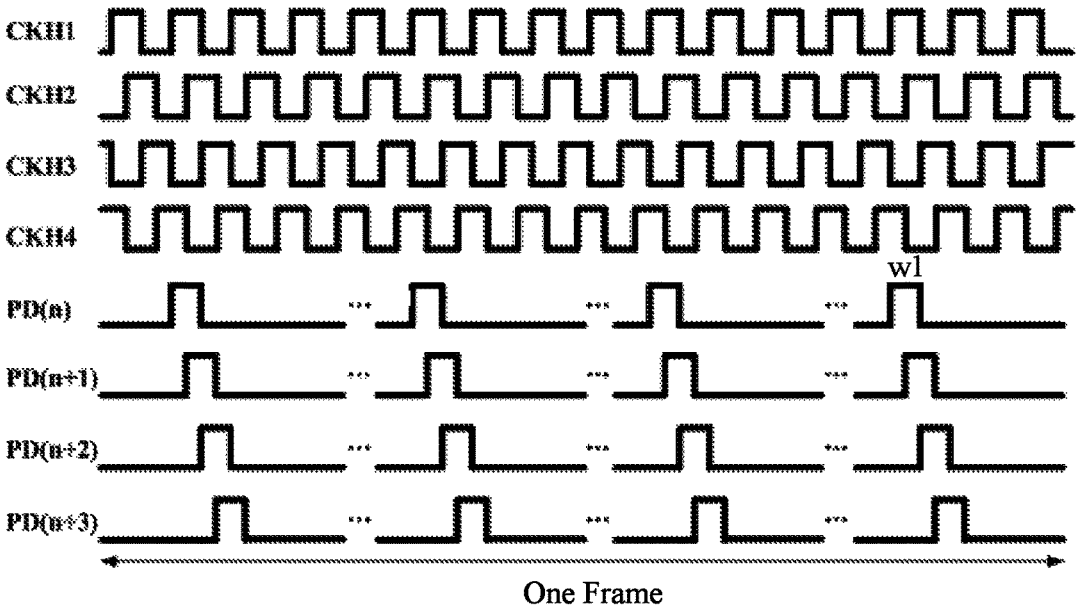
FIG. 5 is a timing diagram of second clock signals and second signals in FIG. 3.

As illustrated in FIG. 5, when the third signal $PD_{n-2}$ is at a logic high level, the second clock signal CKH is at a logic low level and the fourth signal $PD_{n+2}$ is at a logic low level, the third thin film transistor T3, the seventh thin film transistor T7, the eighth thin film transistor T8, the tenth thin film transistor T10 and the eleventh thin film transistor T11 all are turned on, at this time the second signal $PD_n$ is same as the second clock signal CKH, i.e., the second signal $PD_n$ is at a logic low level, the fourth thin film transistor T4, the fifth thin film transistor T5, the ninth thin film transistor T9 and the twelfth thin film transistor T12 all are turned off, the second pulling control signal outputted by the third terminal of the eleventh thin film transistor T11 is at a logic low level. When the gate driving signal $G_n$ is at a logic low level, the thirteenth thin film transistor T13 is turned off, the fourteenth thin film transistor T14 and the fifteenth thin film transistor T15 both are turned off. When the gate driving signal $G_n$ is at a logic high level the thirteenth thin film transistor T13 is turned on, the fourteenth thin film transistor T14 and the fifteenth thin film transistor T15 both are turned off.

When the third signal $PD_{n-2}$ is at a logic low level, the second clock signal CKH is at a logic high level, the second signal $PD_n$ is at a logic high level, and the fourth signal $PD_{n+2}$ is at a logic low level, the third thin film transistor T3 is turned off, the fourth thin film transistor T4, the seventh thin film transistor T7, the eighth thin film transistor T8, the tenth thin film transistor T10 and the eleventh thin film transistor T11 all are turned on, at this time the second signal $PD_n$ is same as the second clock signal CKH, i.e., the second signal $PD_n$ is at a logic high level. The fifth thin film transistor T5, the ninth thin film transistor T9 and the twelfth thin film transistor T12 all are turned off, the second pulling control signal outputted by the third terminal of the eleventh thin film transistor T11 is at a logic high level. When the gate driving signal $G_n$ is at a logic low level, the thirteenth thin film transistor T13 is turned off, the fourteenth thin film transistor T14 and the fifteenth thin film transistor T15 are turned on, the fourteenth thin film transistor T14 pulls the level at the first node $Q_n$ to a logic low level, the fifteenth thin film transistor T15 pulls the level at the output terminal of gate driving signal $G_n$ to a logic low level. When the gate driving signal $G_n$ at a logic high level, the thirteenth thin film transistor T13 is turned on, the fourteenth thin film transistor T14 and the fifteenth thin film transistor T15 both are turned off.

When the third signal $PD_{n-2}$ is at a logic low level, the second clock signal CKH is at a logic low level, the second signal $PD_n$ is at a logic low level and the fourth signal $PD_{n+2}$ is at a logic high level, the third thin film transistor T3, the fourth thin film transistor T4, the seventh thin film transistor T7, the eighth thin film transistor T8, the tenth thin film transistor T10 and the eleventh thin film transistor T11 all are turned off, the fifth thin film transistor T5, the sixth thin film transistor T6, the ninth thin film transistor T9 and the twelfth thin film transistor T12 all are turned on, the second pulling control signal outputted by the third terminal of the eleventh thin film transistor T11 is at a logic low level. When the gate driving signal $G_n$ is at a logic low level, the thirteenth thin film transistor T13 is turned off, the fourteenth thin film transistor T14 and the fifteenth thin film transistor T15 both are turned off. When the gate driving signal $G_n$ is at a logic high level, the thirteenth thin film transistor T13 is turned on, the fourteenth thin film transistor T14 and the fifteenth thin film transistor T15 both are turned off.

The thirteenth thin film transistor T13 is used for ensuring that when the gate driving signal $G_n$ of the gate driving signal output terminal is at a logic high level, the second pulling control signal outputted by the third terminal of the eleventh thin film transistor T11 is maintained at a logic low level, the fourteenth thin film transistor T14 and the fifteenth thin film transistor T15 are kept to be turned off so as to ensure normal working of the gate driving circuit 10.

As illustrated in FIG. 5, each pulse width of the second signal $PD_n$ is w1. In one frame period of the display panel, the fourteenth thin film transistor T14 is used for pulling down the level of the first node $Q_n$, the fifteenth thin film transistor T15 is used for pulling down the gate driving signal $G_n$ of the gate driving signal output terminal, the fourteenth thin film transistor T14 and the fifteenth thin film transistor T15 each are turned on four times, i.e., the fourteenth thin film transistor T14 pulls down the level of the first node $Q_n$ four times and the fifteenth thin film transistor T15 pulls down the gate driving signal $G_n$ four times, which ensures the normal working of the gate driving circuit 10, avoids the fourteenth thin film transistor T14 and the fifteenth thin film transistor T15 to suffer from the pressure of excessively high frequency or excessively low frequency, and therefore can effectively prevent the drift of thin film transistor characteristic of the gate driving unit and improve reliability of the gate driving unit 11. In addition, by adjusting the frequency of the second clock signal CKH, a relatively optimum frequency of the second pulling control signal can be obtained.

Figure 6:
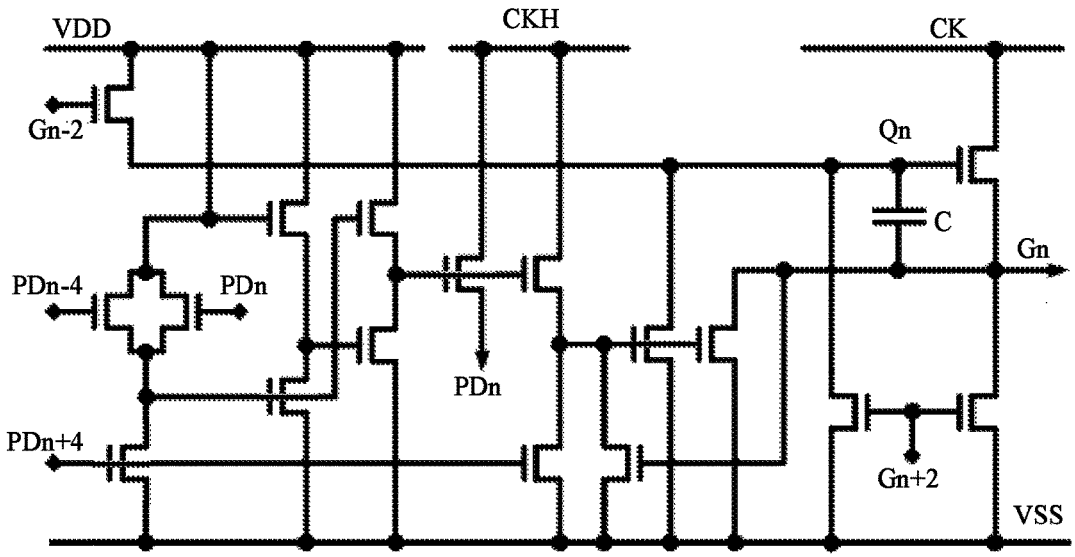
FIG. 6 is a circuit diagram of a gate driving unit of a third embodiment of the invention.

The invention still further provides a gate driving unit of a third embodiment, a difference from the gate driving unit as illustrated in the second embodiment is that: the frequency of the second clock signal CKH is 2 times of the frequency of the first clock signal CK, e.g., the second clock signal CKH uses 8 numbers of clock signals. As illustrated in FIG. 6, the second signal is $PD_n$, the third signal $PD_{n-4}$ is the second signal of fourth preceding stage of gate driving unit, the fourth signal $PD_{n+4}$ is the second signal of fourth succeeding stage of gate driving unit.

Figure 7:
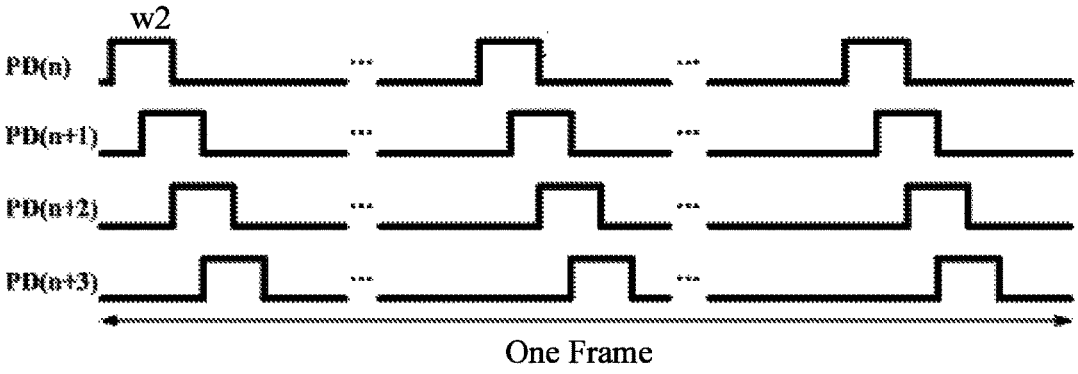
FIG. 7 is a timing diagram of second signals in FIG. 6.

Referring to the timing diagram of FIG. 7, compared with the timing diagram of FIG. 5, it can be found that: the pulse width w2 of the second signal $PD_n$ according to this embodiment is two times of the pulse width w1 as shown in FIG. 5.

Figure 8:
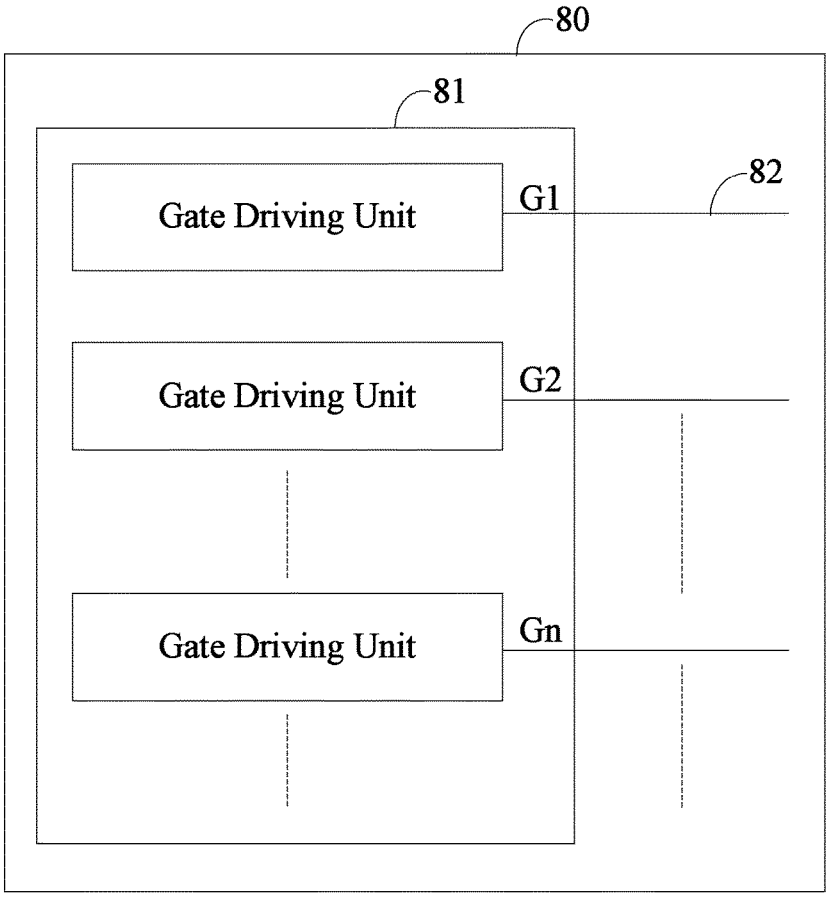
FIG. 8 is a schematic structural view of a display panel of a first embodiment of the invention.

Compared with the gate driving unit as illustrated in the second embodiment, the gate driving unit of this embodiment has lower power consumption. Accordingly, the number/amount of clock signals included in the second clock signal CKH can be set according to actual situation, and usually the number of clock signals included in the second clock signal CKH is 4, 6 or 8. When the number of clock signals included in the second clock signal CKH is h (h is an even number), the second pulling control signal is controlled by the second clock signal CKH, the third signal $PD_{(n-h/2)}$ and the fourth signal $PD_{(n+h/2)}$. When the number of clock signals included in the second clock signal CKH is more, the lower the frequency of the second clock signal CKH is, correspondingly the power consumption is lower, and layout space occupied by the gate driving circuit is larger. When the number of clock signals included in the second clock signal CKH is less, the higher the frequency of the second clock signal CKH is, correspondingly the power consumption is larger, and the layout space occupied by the gate driving circuit is smaller, which is beneficial to the design of display panel with narrow border The invention even still further provides a display panel. As illustrated in FIG. 8, the display panel 80 as illustrated in this embodiment includes a gate driving circuit 81, and the gate driving circuit 81 is the gate driving circuit as described in any one of above embodiments. The gate driving circuit 81 is configured for driving multiple scan lines 82 of the display panel 80 to make the multiple scan lines 82 be turned on, and will not be repeated herein.

Figure 9:
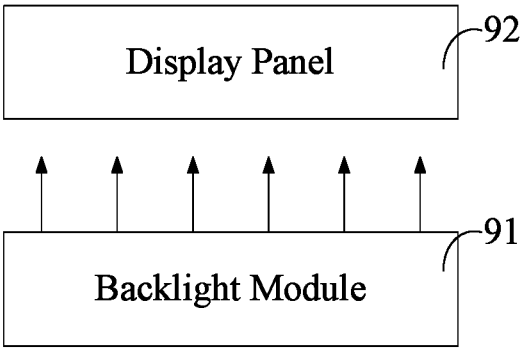
FIG. 9 is a schematic structural view of a liquid crystal display device of a first embodiment of the invention.

The invention further provides a liquid crystal display device. As illustrated in FIG. 9, the liquid crystal display device as illustrated in this embodiment includes a backlight module 91 and a display panel 92, the display panel 92 is disposed above a light output surface of the backlight module 91, and the backlight module 91 is configured for providing the display panel 92 with a light source. The display panel 92 includes the gate driving circuit as described in any one of above embodiments, and the gate driving circuit is configured for driving multiple scan lines of the display panel 92 to make the multiple scan lines be turned on, and will not be repeated herein.

In summary, each stage of gate driving unit according to the invention includes: a first pulling control circuit for outputting a first pulling control signal at a first node; a first pulling circuit coupled to the first node, configured for receiving a first clock signal and generating a gate driving signal according to the first pulling control signal and the first clock signal, and wherein a gate driving signal output terminal outputs the gate driving signal; a second pulling control signal for receiving a first signal, a second signal, a third signal and a fourth signal, and outputting a second pulling control signal according to the first signal, the second signal, the third signal and the fourth signal; and a second pulling circuit coupled to the first node and the gate driving signal output terminal, for receiving the second pulling control signal and pulling a level at the first node as well as a level at the gate driving signal output terminal according to the second pulling control signal. A frequency of the second pulling control signal is lower than a frequency of the first clock signal but higher than a refresh rate of the display panel, which can effectively prevent the drift of thin film transistor characteristic of the gate driving unit and thereby improve the reliability of the gate driving unit.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A gate driving circuit, wherein the gate driving circuit comprises a plurality of stages of gate driving units, and each stage of gate driving unit comprises:

a first pulling control circuit, configured for outputting a first pulling control signal at a first node;

a first pulling circuit, coupled to the first node and configured for receiving a first clock signal and generating a gate driving signal according to the first pulling control signal and the first clock signal, and having a gate driving signal output terminal for outputting the gate driving signal;

a second pulling control circuit, configured for receiving a first signal, a second signal, a third signal and a fourth signal, and outputting a second pulling control signal according to the first signal, the second signal, the third signal and the fourth signal;

a second pulling circuit, coupled to the first node and the gate driving signal output terminal and configured for receiving the second pulling control signal and pulling a level at the first node and a level at the gate driving signal output terminal according to the second pulling control signal;

wherein a frequency of the second pulling control signal is lower than a frequency of the first clock signal but higher than a refresh rate of a display panel to which the gate driving circuit is applied, the second pulling control signal is a square wave pulse control signal;

wherein the first signal is a second clock signal, and a ratio of a frequency of the second clock signal to the frequency of the first clock signal is in a range from 2 to 50;

wherein the frequency of the second clock signal is 4 times of the frequency of the first clock signal, the third signal is the second signal of second preceding stage of gate driving unit, and the fourth signal is the second signal of second succeeding stage of gate driving unit.

2. A gate driving circuit, wherein the gate driving circuit comprises a plurality of stages of gate driving units, and each stage of gate driving unit comprises:

a first pulling control circuit, configured for outputting a first pulling control signal at a first node;

a first pulling circuit, coupled to the first node and configured for receiving a first clock signal and generating a gate driving signal according to the first pulling control signal and the first clock signal, and having a gate driving signal output terminal for outputting the gate driving signal;

a second pulling control circuit, configured for receiving a first signal, a second signal, a third signal and a fourth signal and outputting a second pulling control signal according to the first signal, the second signal, the third signal and the fourth signal;

a second pulling circuit, coupled to the first node and the gate driving signal output terminal and configured for receiving the second pulling control signal and pulling a level at the first node and a level at the gate driving signal output terminal according to the second pulling control signal;

wherein a frequency of the second pulling control signal is lower than a frequency of the first clock signal but higher than a refresh rate of a display panel to which the gate driving circuit is applied;

wherein the first signal is a second clock signal, the frequency of the second clock signal is 4 times of the frequency of the first clock signal, the third signal is the second signal of second preceding stage of gate driving unit, and the fourth signal is the second signal of second succeeding stage of gate driving unit.

3. The gate driving circuit as claimed in claim 2, wherein the second pulling control signal is a square wave pulse control signal.

4. The gate driving circuit as claimed in claim 2, wherein a ratio of a frequency of the second clock signal to the frequency of the first clock signal is in a range from 2 to 50.

5. The gate driving circuit as claimed in claim 4, wherein the frequency of the second clock signal is 2 times of the frequency of the first clock signal, the third signal is the second signal of fourth preceding stage of gate driving unit, and the fourth signal is the second signal of fourth succeeding stage of gate driving unit.

6. The gate driving circuit as claimed in claim 2, wherein the first pulling control circuit comprises a first thin film transistor, a first terminal of the first thin film transistor is configured for receiving a first reference voltage, a second terminal of the first thin film transistor is configured for receiving the gate driving signal of second preceding stage of gate driving unit, and a third terminal of the first thin film transistor is connected to the first node.

7. The gate driving circuit as claimed in claim 6, wherein the first pulling circuit comprises a second thin film transistor and a capacitor, a first terminal of the second thin film transistor is configured for receiving the first clock signal, a second terminal of the second thin film transistor is connected to the first node, a third terminal of the second thin film transistor acts as the gate driving signal output terminal, a terminal of the capacitor is connected to the first node and another terminal of the capacitor is connected to the third terminal of the second thin film transistor.

8. The gate driving circuit as claimed in claim 7, wherein the second pulling control circuit comprises a third thin film transistor, a fourth thin film transistor, a fifth thin film transistor, a sixth thin film transistor, a seventh thin film transistor, an eighth thin film transistor, a ninth thin film transistor, a tenth thin film transistor, an eleventh thin film transistor, a twelfth thin film transistor and a thirteenth thin film transistor; a first terminal of the third thin film transistor and a first terminal of the fourth thin film transistor are configured for receiving the first reference voltage, a second terminal of the third thin film transistor is configured for receiving the third signal, a second terminal of the fourth thin film transistor is configured for receiving the second signal of current stage of gate driving unit, a third terminal of the third thin film transistor and a third terminal of the fourth thin film transistor are connected to a first terminal of the fifth thin film transistor, a second terminal of the seventh thin film transistor and a second terminal of the eighth thin film transistor, a second terminal of the fifth thin film transistor and a second terminal of the twelfth thin film transistor are configured for receiving the fourth signal, a second terminal of the thirteenth thin film transistor is connected to the gate driving signal output terminal; a third terminal of the fifth thin film transistor, a third terminal of the seventh thin film transistor, a third terminal of the ninth thin film transistor, a third terminal of the twelfth thin film transistor and a third terminal of the thirteenth thin film transistor are configured for receiving a second reference voltage, a first terminal and a second terminal of the sixth thin film transistor are configured for receiving the first reference voltage, a third terminal of the sixth thin film transistor is connected to a first terminal of the seventh thin film transistor and a second terminal of the ninth thin film transistor, a first terminal of the eighth thin film transistor is configured for receiving the first reference voltage, a third terminal of the eighth thin film transistor is connected to a first terminal of the ninth thin film transistor, a second terminal of the tenth thin film transistor and a second terminal of the eleventh thin film transistor; a first terminal of the tenth thin film transistor is configured for receiving the first signal, a third terminal of the tenth thin film transistor is configured for outputting the second signal, a first terminal of the eleventh thin film transistor is configured for receiving the first signal, a third terminal of the eleventh thin film transistor is connected to a first terminal of the twelfth thin film transistor and a first terminal of the thirteenth thin film transistor, a third terminal of the eleventh thin film transistor is configured for outputting the second pulling control signal.

9. The gate driving circuit as claimed in claim 8, wherein the second pulling circuit comprises a fourteenth thin film transistor, a fifteenth thin film transistor, a sixteenth thin film transistor and a seventeenth thin film transistor; a first terminal of the fourteenth thin film transistor is connected to the first node, a second terminal of the fourteenth thin film transistor and a second terminal of the fifteenth thin film transistor are connected to the third terminal of the eleventh thin film transistor; a third terminal of the fourteenth thin film transistor, a third terminal of the fifteenth thin film transistor, a third terminal of the sixteenth thin film transistor and a third terminal of the seventeenth thin film transistor are configured for receiving the second reference voltage, a first terminal of the fifteenth thin film transistor is connected to the gate driving signal output terminal, a first terminal of the sixteenth thin film transistor is connected to the first node, a second terminal of the sixteenth thin film transistor and a second terminal of the seventeenth are configured for receiving the gate driving signal of second succeeding stage of gate driving unit, a first terminal of the seventeenth thin film transistor is connected to the gate driving signal output terminal.

10. A display panel, wherein the display panel comprises a gate driving circuit; the gate driving circuit comprises a plurality of stages of gate driving units, and each stage of gate driving unit comprises:

a first pulling control circuit, configured for outputting a first pulling control signal at a first node;

a first pulling circuit, coupled to the first node and configured for receiving a first clock signal and generating a gate driving signal according to the first pulling control signal and the first clock signal, and having a gate driving signal output terminal for outputting the gate driving signal;

a second pulling control circuit, configured for receiving a first signal, a second signal, a third signal and a fourth signal and outputting a second pulling control signal according to the first signal, the second signal, the third signal and the fourth signal;

a second pulling circuit, coupled to the first node and the gate driving signal output terminal and configured for receiving the second pulling control signal and pulling a level at the first node and a level at the gate driving signal output terminal according to the second pulling control signal;

wherein a frequency of the second pulling control signal is lower than a frequency of the first clock signal but higher than a refresh rate of the display panel;

wherein the first signal is a second clock signal, the frequency of the second clock signal is 4 times of the frequency of the first clock signal, the third signal is the second signal of second preceding stage of gate driving unit, and the fourth signal is the second signal of second succeeding stage of gate driving unit.

11. The display panel as claimed in claim 10, wherein the second pulling control signal is a square wave pulse control signal.

12. The display panel as claimed in claim 10, wherein a ratio of a frequency of the second clock signal to the frequency of the first clock signal is in a range from 2 to 50.

13. The display panel as claimed in claim 12, wherein the frequency of the second clock signal is 2 times of the frequency of the first clock signal, the third signal is the second signal of fourth preceding stage of gate driving unit, and the fourth signal is the second signal of fourth succeeding stage of gate driving unit.

14. The display panel as claimed in claim 10, wherein the first pulling control circuit comprises a first thin film transistor, a first terminal of the first thin film transistor is configured for receiving a first reference voltage, a second terminal of the first thin film transistor is configured for receiving the gate driving signal of second preceding stage of gate driving unit, and a third terminal of the first thin film transistor is connected to the first node.

15. The display panel as claimed in claim 14, wherein the first pulling circuit comprises a second thin film transistor and a capacitor, a first terminal of the second thin film transistor is configured for receiving the first clock signal, a second terminal of the second thin film transistor is connected to the first node, a third terminal of the second thin film transistor acts as the gate driving signal output terminal, a terminal of the capacitor is connected to the first node and another terminal of the capacitor is connected to the third terminal of the second thin film transistor.

16. The display panel as claimed in claim 15, wherein the second pulling control circuit comprises a third thin film transistor, a fourth thin film transistor, a fifth thin film transistor, a sixth thin film transistor, a seventh thin film transistor, an eighth thin film transistor, a ninth thin film transistor, a tenth thin film transistor, an eleventh thin film transistor, a twelfth thin film transistor and a thirteenth thin film transistor; a first terminal of the third thin film transistor and a first terminal of the fourth thin film transistor are configured for receiving the first reference voltage, a second terminal of the third thin film transistor is configured for receiving the third signal, a second terminal of the fourth thin film transistor is configured for receiving the second signal of current stage of gate driving unit, a third terminal of the third thin film transistor and a third terminal of the fourth thin film transistor are connected to a first terminal of the fifth thin film transistor, a second terminal of the seventh thin film transistor and a second terminal of the eighth thin film transistor, a second terminal of the fifth thin film transistor and a second terminal of the twelfth thin film transistor are configured for receiving the fourth signal, a second terminal of the thirteenth thin film transistor is connected to the gate driving signal output terminal; a third terminal of the fifth thin film transistor, a third terminal of the seventh thin film transistor, a third terminal of the ninth thin film transistor, a third terminal of the twelfth thin film transistor and a third terminal of the thirteenth thin film transistor are configured for receiving a second reference voltage, a first terminal and a second terminal of the sixth thin film transistor are configured for receiving the first reference voltage, a third terminal of the sixth thin film transistor is connected to a first terminal of the seventh thin film transistor and a second terminal of the ninth thin film transistor, a first terminal of the eighth thin film transistor is configured for receiving the first reference voltage, a third terminal of the eighth thin film transistor is connected to a first terminal of the ninth thin film transistor, a second terminal of the tenth thin film transistor and a second terminal of the eleventh thin film transistor; a first terminal of the tenth thin film transistor is configured for receiving the first signal, a third terminal of the tenth thin film transistor is configured for outputting the second signal, a first terminal of the eleventh thin film transistor is configured for receiving the first signal, a third terminal of the eleventh thin film transistor is connected to a first terminal of the twelfth thin film transistor and a first terminal of the thirteenth thin film transistor, a third terminal of the eleventh thin film transistor is configured for outputting the second pulling control signal.

17. The display panel as claimed in claim 16, wherein the second pulling circuit comprises a fourteenth thin film transistor, a fifteenth thin film transistor, a sixteenth thin film transistor and a seventeenth thin film transistor; a first terminal of the fourteenth thin film transistor is connected to the first node, a second terminal of the fourteenth thin film transistor and a second terminal of the fifteenth thin film transistor are connected to the third terminal of the eleventh thin film transistor; a third terminal of the fourteenth thin film transistor, a third terminal of the fifteenth thin film transistor, a third terminal of the sixteenth thin film transistor and a third terminal of the seventeenth thin film transistor are configured for receiving the second reference voltage, a first terminal of the fifteenth thin film transistor is connected to the gate driving signal output terminal, a first terminal of the sixteenth thin film transistor is connected to the first node, a second terminal of the sixteenth thin film transistor and a second terminal of the seventeenth are configured for receiving the gate driving signal of second succeeding stage of gate driving unit, a first terminal of the seventeenth thin film transistor is connected to the gate driving signal output terminal.

* * * * *